US009394135B2

(12) United States Patent
Furuta et al.

(10) Patent No.: US 9,394,135 B2
(45) Date of Patent: Jul. 19, 2016

(54) IMAGE FORMING APPARATUS INCLUDING DISCHARGE UNIT

(71) Applicant: KYOCERA Document Solutions Inc., Osaka-shi, Osaka (JP)

(72) Inventors: Shinji Furuta, Osaka (JP); Tomoya Hotani, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/857,680

(22) Filed: Sep. 17, 2015

(65) Prior Publication Data

US 2016/0083215 A1 Mar. 24, 2016

(30) Foreign Application Priority Data

Sep. 24, 2014 (JP) ..... 2014-193370

(51) Int. Cl.
*B65H 37/00* (2006.01)
*B65H 29/14* (2006.01)
*G03G 15/00* (2006.01)

(52) U.S. Cl.
CPC ..... *B65H 37/00* (2013.01); *B65H 29/14* (2013.01); *G03G 15/6552* (2013.01); *B65H 2301/5133* (2013.01); *B65H 2601/273* (2013.01); *B65H 2801/03* (2013.01)

(58) Field of Classification Search
None
See application file for complete search history.

(56) References Cited

U.S. PATENT DOCUMENTS 5,579,098 A * 11/1996 Noguchi ..... G03G 15/2064 399/122
2010/0150634 A1* 6/2010 Yoshida ..... B65H 29/14 399/405

FOREIGN PATENT DOCUMENTS

JP 2001117305 A 4/2001

* cited by examiner

*Primary Examiner* — Clayton E Laballe
*Assistant Examiner* — Jas Sanghera
(74) *Attorney, Agent, or Firm* — Alleman Hall McCoy Russell & Tuttle LLP

(57) ABSTRACT

An image forming apparatus includes a discharge unit, a discharge roller, a pressing member, and a reinforcing frame. The discharge unit includes a guide member that forms a discharge path that guides a sheet member to a sheet discharge port. The discharge roller discharges the sheet member to outside from the sheet discharge port. The pressing member projects from the guide member toward the discharge path, and contacts and presses the sheet member that is passing through the discharge path. The reinforcing frame, formed from a metal plate material, is made conductive with a reference potential portion of the apparatus main body and reinforces the discharge unit by being, together with the discharge unit, fixed to the apparatus main body in a state of covering a part of the guide member to which the pressing member is attached.

6 Claims, 10 Drawing Sheets

IMAGE FORMING APPARATUS INCLUDING DISCHARGE UNIT

INCORPORATION BY REFERENCE

This application is based upon and claims the benefit of priority from the corresponding Japanese Patent Application No. 2014-193370 filed on Sep. 24, 2014, the entire contents of which are incorporated herein by reference.

BACKGROUND

The present disclosure relates to an image forming apparatus that includes a discharge unit for discharging a sheet member after image formation to outside from a sheet discharge port.

There is known an image forming apparatus that performs image formation based on the electrophotography. The image forming apparatus includes a fixing device and a discharge unit. The fixing device fixes a toner image that has been transferred to a surface of a sheet member such as a print sheet, to the sheet member by causing the toner image to fuse. The discharge unit is disposed more in the downstream side in the sheet member conveyance direction than the fixing device. The discharge unit includes a discharge path inside, and the sheet member to which the toner image has been fixed passes through the discharge path and is discharged from a predetermined sheet discharge port to an external tray.

In this type of image forming apparatus, an electric field is generated between a sheet member and a photoconductor drum, and a potential difference in the electric field is used for the toner image to be transferred from the photoconductor drum to the sheet member. At this time, the sheet member is put in the electric field, and electric charges of positive or negative polarity are generated on the sheet member. In addition, while the sheet member is conveyed in a conveyance path, electric charges of positive or negative polarity are generated on the sheet member due to a friction between the sheet member and a conveyance guide surface. The phenomenon in which electric charges are generated on an object is called charging. When a sheet member such as a print sheet that is made of an insulator is charged, the generated charges do not flow, but are accumulated on the sheet member as static electricity. The sheet member contacts the conveyance guide surface and receives friction therefrom until immediately before being discharged from the sheet discharge port. As a result, the amount of static electricity charged on the sheet member becomes the largest immediately before the sheet member is discharged from the sheet discharge port. For this reason, conventionally, an electricity removing member, such as an electricity removing brush, is provided near the sheet discharge port, wherein the electricity removing member removes static electricity from the sheet member.

In addition, some conventional image forming apparatuses include a pressing member for giving stiffness (also called "toughness" or "rigidity") to the sheet member before it is discharged. The pressing member is provided in the discharge path in the discharge unit. Specifically, the pressing member is provided near a discharge roller in the discharge path. The pressing member curves the sheet member by contacting and pressing the sheet member. With this configuration, the sheet member is stiffened when it is discharged, and thereby the sheet member is prevented from hanging down immediately after the discharge.

In addition, conventionally, there has been known a frame configuration for ensuring the rigidity of the image forming apparatus while realizing the downsizing thereof. Conventionally, reduction of the image forming apparatus in size and cost has been demanded, and downsizing of the discharge unit has been promoted. On the other hand, upsizing of the sheet member on which an image can be formed by the image forming apparatus is desired. In recent years, an image forming apparatus that can form an image on a sheet member of A3 size has been known.

SUMMARY

An image forming apparatus according to an aspect of the present disclosure includes a discharge unit, a discharge roller, a pressing member, and a reinforcing frame. The discharge unit includes a guide member that forms a discharge path that guides a sheet member after image formation to a sheet discharge port. The discharge unit is attached to an apparatus main body. The discharge path is formed inside the discharge unit by the guide member. The discharge roller is disposed in a vicinity of the sheet discharge port of the discharge unit, and discharges the sheet member in the discharge path to outside from the sheet discharge port. The pressing member is attached to the guide member more in an upstream side than the sheet discharge port in a sheet member discharge direction, the pressing member projecting from the guide member toward the discharge path and configured to contact and press the sheet member that is passing through the discharge path. The reinforcing frame is made conductive with a reference potential portion of the apparatus main body and configured to reinforce the discharge unit by being, together with the discharge unit, fixed to the apparatus main body in a state of covering a part of the guide member to which the pressing member is attached. The reinforcing frame is formed from a metal plate material.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
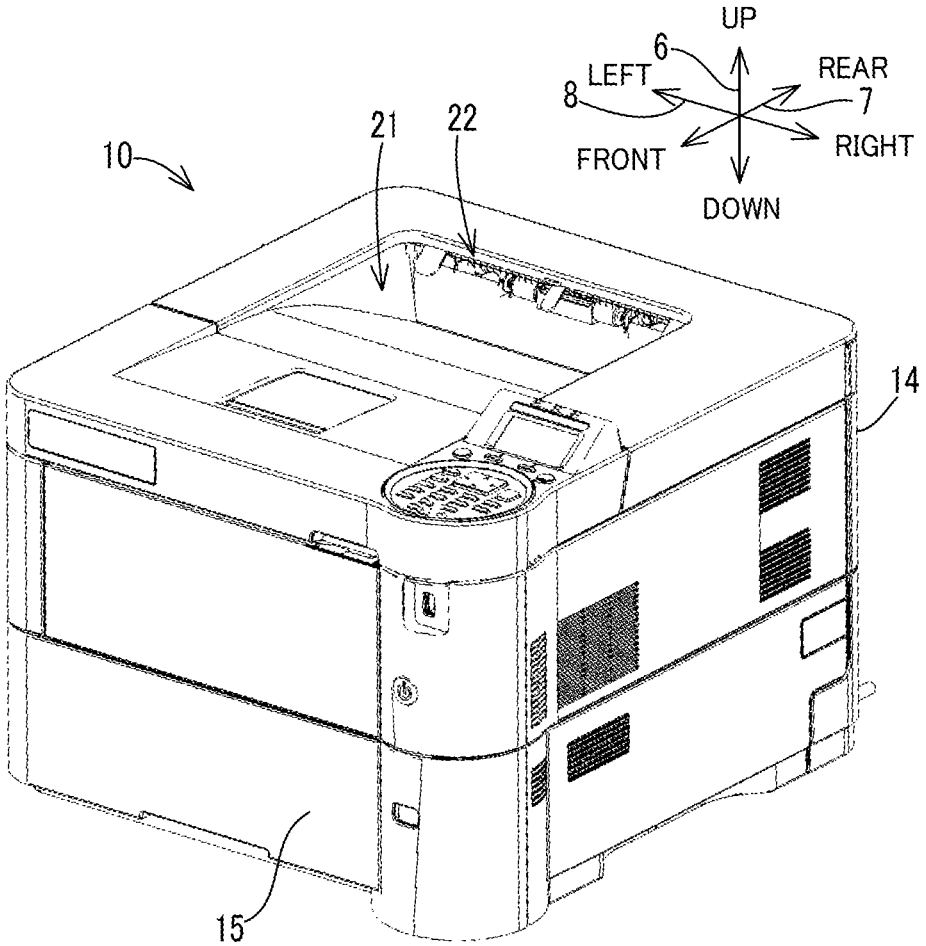
FIG. 1 is a perspective view showing an image forming apparatus according to an embodiment of the present disclosure.

The following describes an embodiment of the present disclosure with reference to the attached drawings. It should be noted that the following description is an example of a specific embodiment of the present disclosure and should not limit the technical scope of the present disclosure. It is noted that for the sake of explanation, an up-down direction 6 is defined based on the state (the state shown in FIG. 1) where an image forming apparatus 10 according to the embodiment of the present disclosure is installed on a flat surface. In addition, a front-rear direction 7 is defined on the supposition that the front side on the plane of FIG. 1 is the front. Furthermore, a left-right direction 8 is defined based on the image forming apparatus 10 viewed from the front side.

[Image Forming Apparatus 10]

Figure 2A:
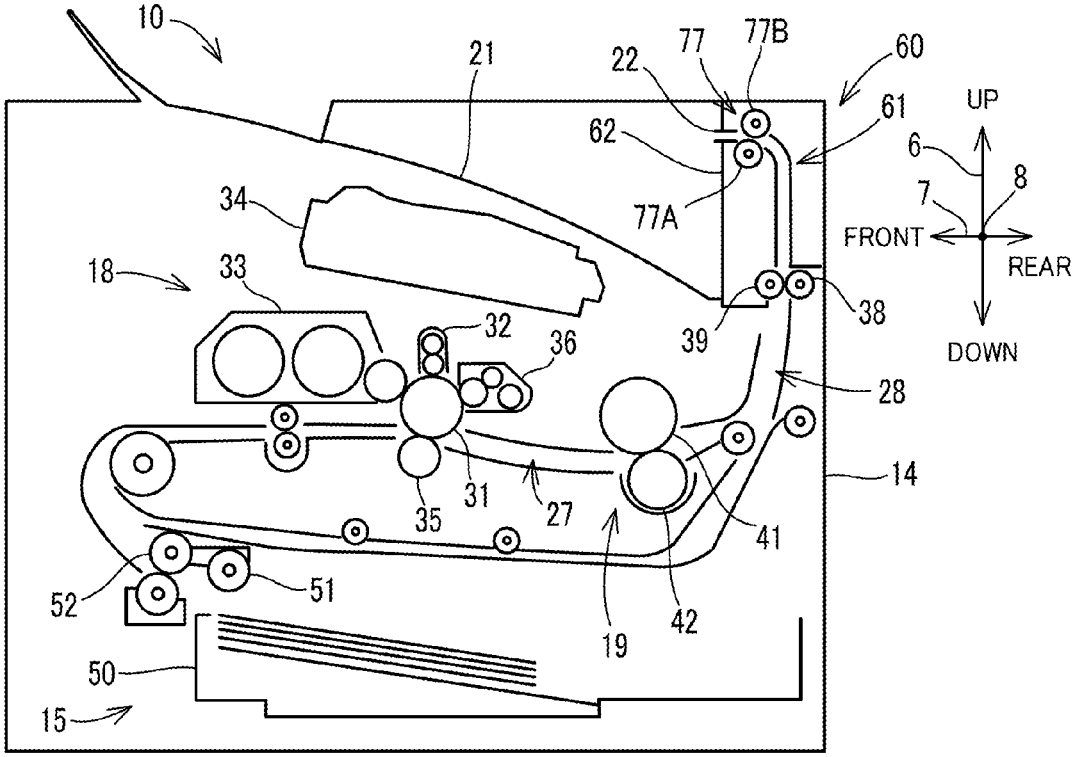
FIG. 2A and FIG. 2B are cross-sectional views showing a configuration of the image forming apparatus.
Figure 2B:
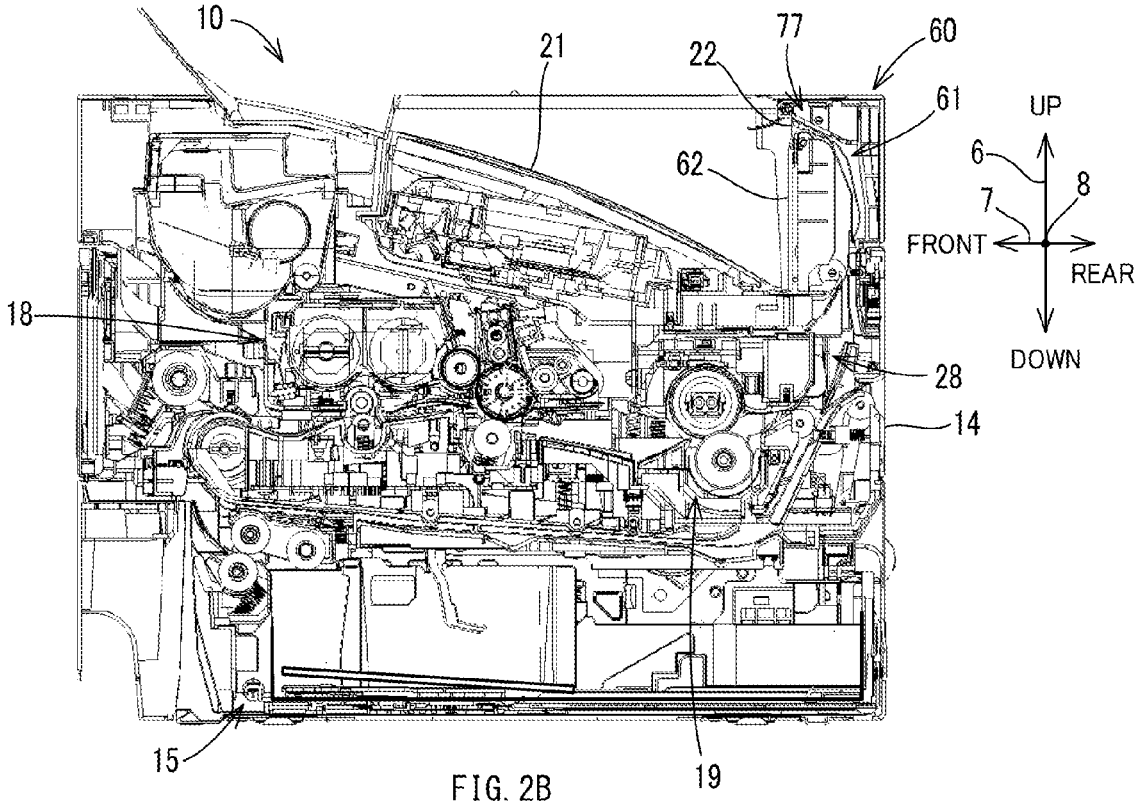

The image forming apparatus 10 is shown in FIG. 1, FIG. 2A, and FIG. 2B. The image forming apparatus 10 is a multifunction peripheral having a plurality of functions such as the functions of a printer and a facsimile. The image forming apparatus 10 prints an input image on a print sheet (an example of the sheet member) made from vegetable fibers such as pulps, by using a print material such as toner. The print sheet is an insulator (also called a nonconductor or a poor conductor), and has a low electric conductivity. It is noted that the image forming apparatus 10 is not limited to a multifunction peripheral, but may be any device having a print function, for example, an image forming apparatus such as a printer, a facsimile, or a copier. In addition, the image forming apparatus 10 may be an apparatus that forms a color image or an apparatus that forms a monochrome image.

The image forming apparatus 10 prints an image on a print sheet based on image data input from an external source via a network communication portion (not shown). As shown in FIGS. 2A and 2B, the image forming apparatus 10 includes an electrophotographic image forming portion 18, a fixing portion 19, a sheet feed device 15, a LSU (Laser Scanner Unit) 34, a discharge unit 60, and a discharged-sheet stacking portion 21. These components are provided inside a housing 14 (an example of the apparatus main body) that constitutes a cover of an external frame and an internal frame of the image forming apparatus 10.

As shown in FIGS. 2A and 2B, the sheet feed device 15 is provided in the lowest part of the image forming apparatus 10. The sheet feed device 15 includes a sheet feed tray 50, a pick-up roller 51, and a sheet feed roller 52. On the sheet feed tray 50, print sheets on which images are formed by the image forming portion 18 are stacked. The sheet feed tray 50 is supported by the housing 14. The pick-up roller 51 and the sheet feed roller 52 are provided on the upper front side of the sheet feed tray 50. When an instruction to start feeding a print sheet is input to the image forming apparatus 10, the pick-up roller 51 is rotationally driven by a conveyance motor (not shown), and a print sheet is fed from the sheet feed tray 50. The print sheet fed by the pick-up roller 51 is conveyed by the sheet feed roller 52 toward the downstream in the feeding direction.

The image forming portion 18 forms an image on a print sheet of a standard size such as an A series size (for example, A5 size, A4 size, or A3 size) or a B series size (for example, B5 size or B4 size), based on image data input from an external source. The image forming portion 18 transfers a toner image to a print sheet by using a print material such as toner. Specifically, as shown in FIG. 2A, the image forming portion 18 includes a photoconductor drum 31, a charging portion 32, a developing portion 33, a transfer portion 35, and a cleaning portion 36. When an image forming operation is started, the charging portion 32 charges the surface of the photoconductor drum 31 uniformly into a certain potential. In addition, the LSU 34 scans the photoconductor drum 31 with a laser beam based on the image data. With this operation, an electrostatic latent image is formed on the photoconductor drum 31. An electric field of a predetermined potential difference is formed between the developing portion 33 and the photoconductor drum 31. Due to the potential difference, the toner stored in the developing portion 33 adheres to the electrostatic latent image so as to form a toner image on the photoconductor drum 31. An electric field of a predetermined potential difference is formed between the photoconductor drum 31 and the transfer portion 35. Due to the potential difference, the toner image is transferred from the photoconductor drum 31 to a print sheet fed from the sheet feed tray 50. The print sheet to which the toner image has been transferred is conveyed to the fixing portion 19.

The fixing portion 19 is provided in the rear side of the image forming portion 18. The fixing portion 19 fixes the toner image that has been transferred to the print sheet, to the print sheet by heat. The fixing portion 19 includes a heating roller 41 and a pressure roller 42. The heating roller 41 is heated by a heating means such as an IH heater during a fixing operation. The pressure roller 42 is biased toward the heating roller 41 by an elastic member. When the print sheet passes through the fixing portion 19, the print sheet is pressed by the fixing portion 19 while the toner is heated and fused and adheres to the print sheet. This allows the toner image to be fixed to the print sheet, thereby an image is formed on the print sheet. At this time, the print sheet is heated to a high temperature.

A conveyance path 28 is provided more in the rear side than the fixing portion 19. The conveyance path 28 is formed by a pair of guide members (not shown). The conveyance path 28 is formed in the shape of extending rearward and then curving and extending upward along the rear surface of the image forming apparatus 10. The end of the conveyance path 28 is connected to a discharge path 61 formed inside the discharge unit 60, wherein the discharge path 61 is described below. A driven roller 38 is rotatably provided in the vicinity of the end of the conveyance path 28. The driven roller 38 is pressed against a conveyance roller 39 provided in the discharge unit 60, wherein the conveyance roller 39 is described below.

Figure 3:
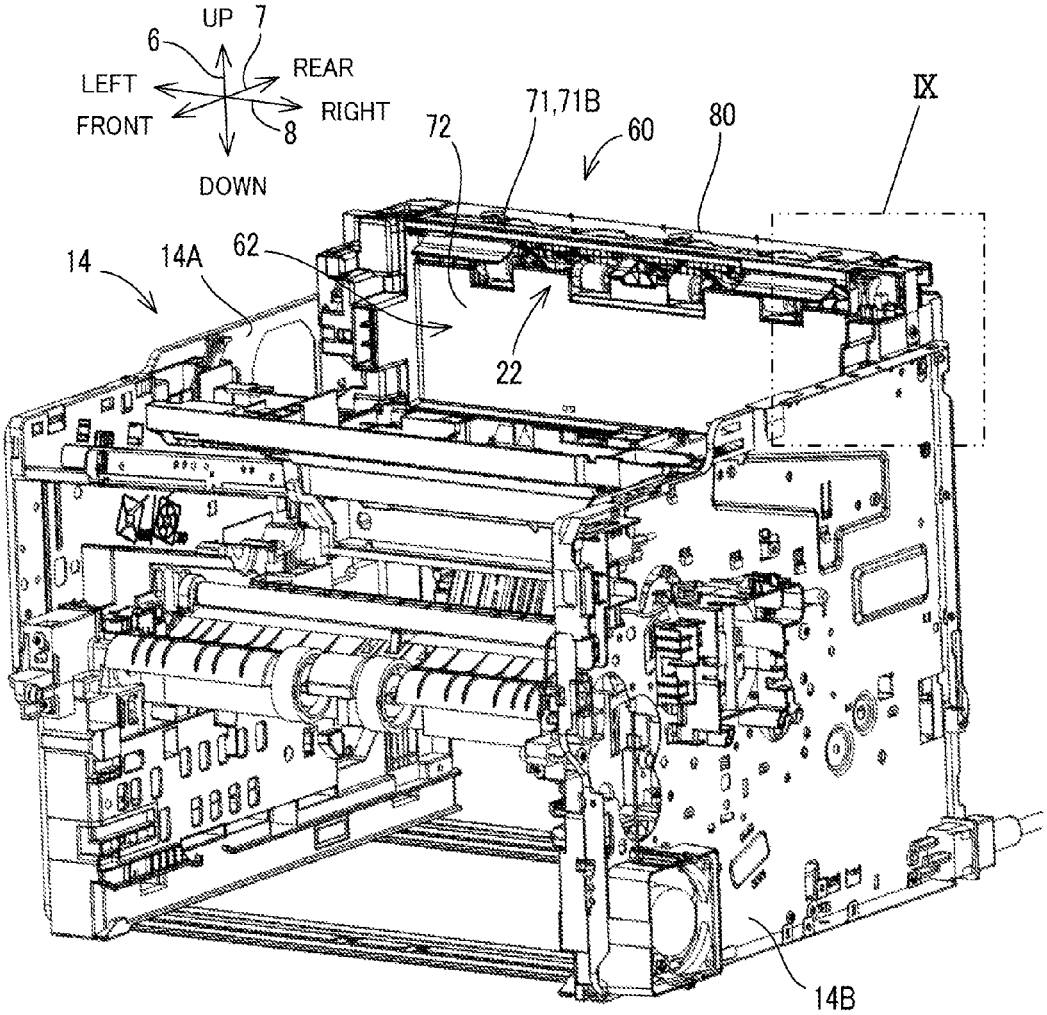
FIG. 3 is a perspective view showing a housing and a discharge unit of the image forming apparatus.

As shown in FIGS. 2A and 2B, the discharged-sheet stacking portion 21 is provided on an upper surface of the image forming apparatus 10. In addition, as shown in FIG. 3, the discharge unit 60 is attached to an upper part of the housing 14 in the rear side. The discharge unit 60 is integrated with the image forming apparatus 10 by being attached to the housing 14.

[Discharge Unit 60]

Figure 4:
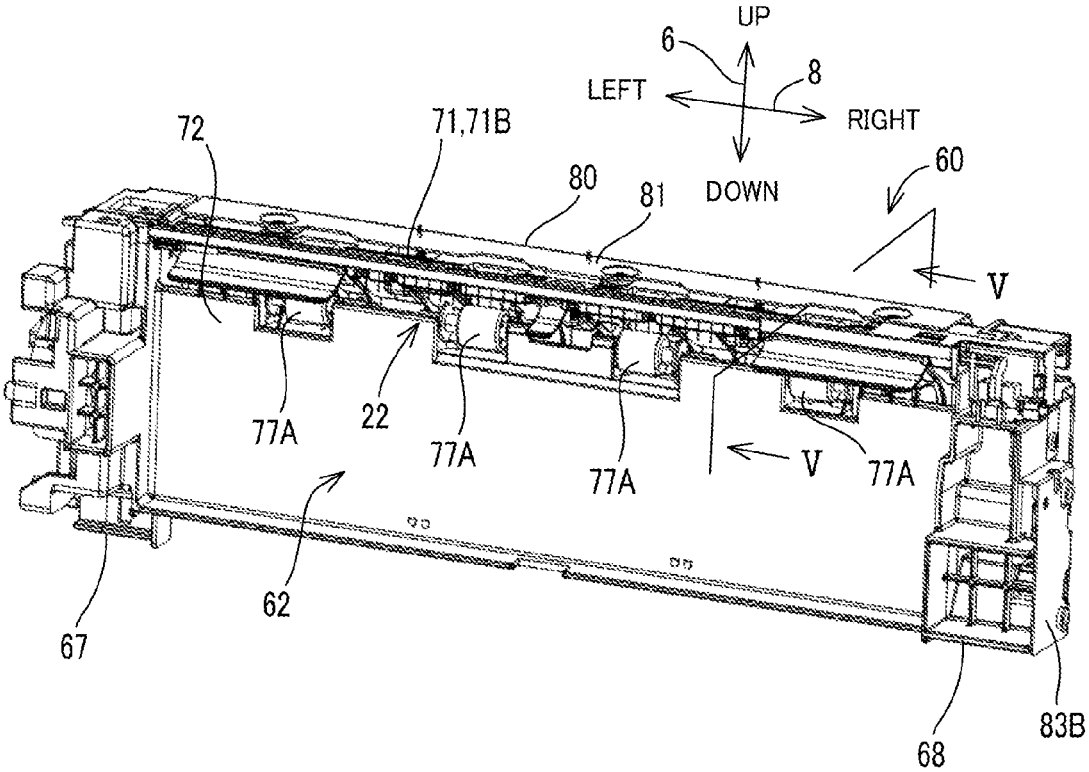
FIG. 4 is a perspective view showing the discharge unit.

The discharge unit 60 discharges, to the discharged-sheet stacking portion 21, a print sheet after image formation to which an image has been fixed by the fixing portion 19. As shown in FIG. 3 and FIG. 4, the discharge unit 60 is formed in the shape of being elongated in one direction. Specifically, the discharge unit 60 is formed in the shape of being elongated in a width direction (a direction that matches the left-right direction 8 of the image forming apparatus 10) perpendicular to a discharge direction in which the print sheet is discharged. Here, FIG. 3 shows a state where the external frame cover, the sheet feed device 15 and the like have been removed from the image forming apparatus 10. As shown in FIG. 3, the housing 14 includes a pair of side frames 14A and 14B that are plate-like and separated from each other in the left-right direction 8. The side frames 14A and 14B are made of a conductive material. Specifically, the side frames 14A and 14B are made from metal plates. Opposite ends of the discharge unit 60 in the longitudinal direction are supported by the side frames 14A and 14B. It is noted that the side frame 14A is grounded by a ground line. That is, the potential of the side frame 14A is a ground potential. The side frame 14A having the ground potential in this way corresponds to the reference potential portion of the present disclosure.

Figure 5:
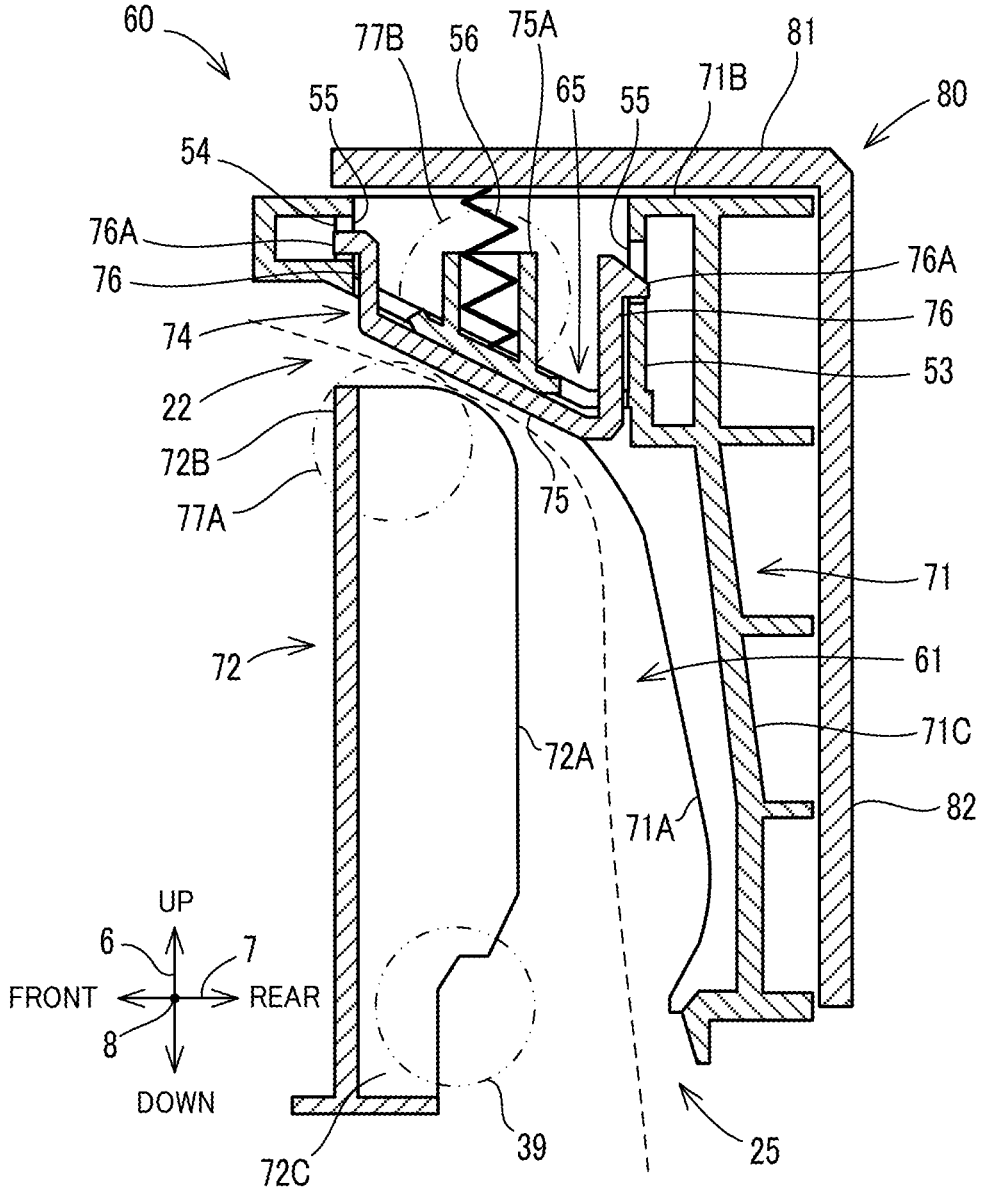
FIG. 5 is a schematic cross-sectional view taken along a cutting plane V-V in FIG. 4.
Figure 7:
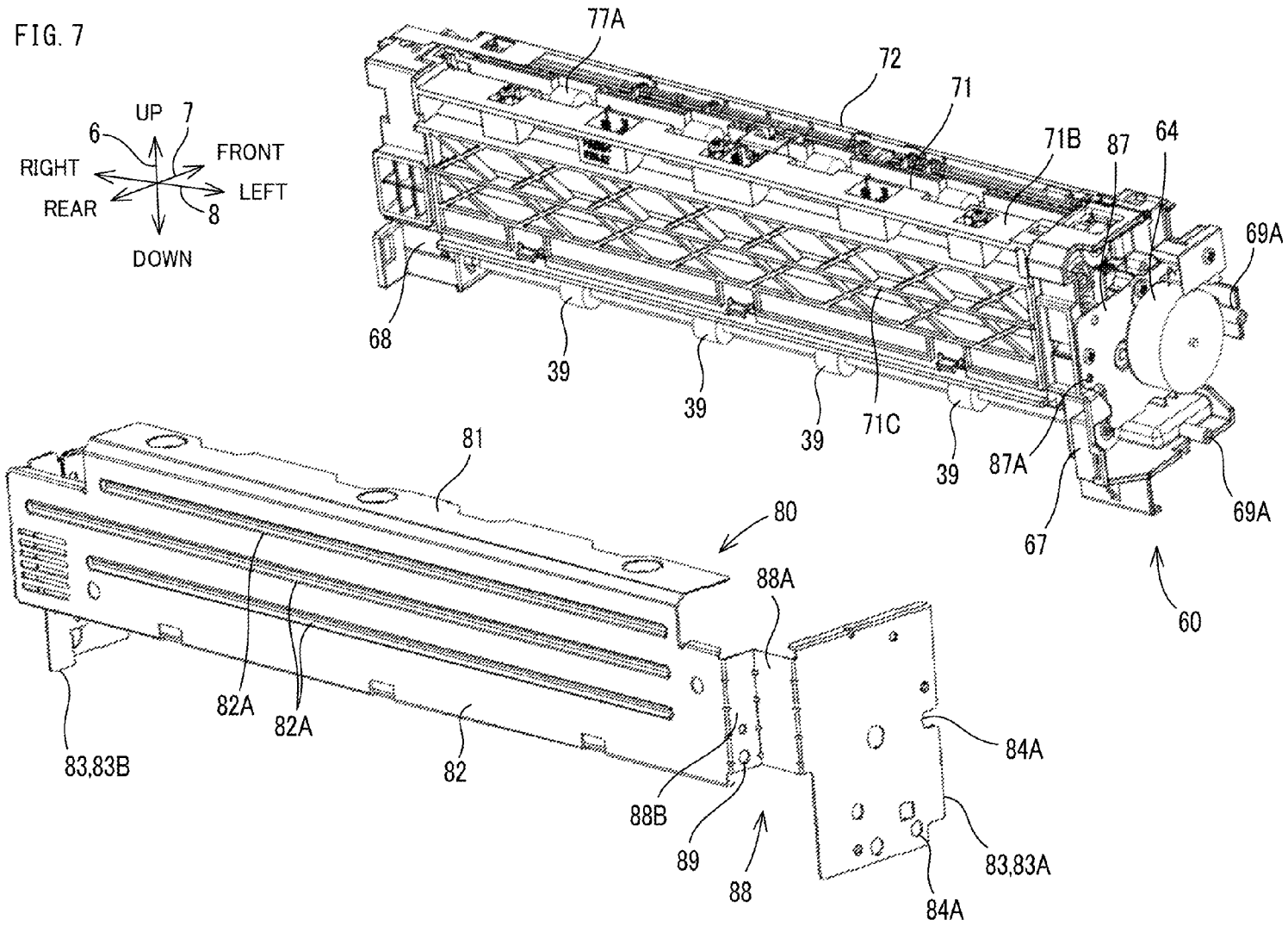
FIG. 7 is an exploded view of the discharge unit.

As shown in FIG. 4 and FIG. 5, the discharge unit 60 includes a pair of guide members 71 and 72, a pair of discharge rollers 77 (77A and 77B), a conveyance roller 39, a pressing member 74, and a discharge motor 64 (see FIG. 7). In addition, a reinforcing frame 80 is attached to the discharge unit 60. It is noted that opposite end portions of the discharge unit 60 and the reinforcing frame 80 in the left-right direction 8 are omitted to be shown in FIG. 5.

As shown in FIG. 5, the pair of guide members 71 and 72 are formed in the shape of being elongated in the longitudinal direction of the discharge unit 60 (a direction matching the left-right direction 8 of the image forming apparatus 10). The discharge path 61 in the discharge unit 60 is formed by the pair of guide members 71 and 72. As shown in FIG. 2A and FIG. 5, a sheet discharge port 22 (an example of the sheet discharge port) is provided on an upper part of a front surface 62 (a side surface of the front side) of the discharge unit 60. In addition, a reception port 25 for receiving a print sheet from the conveyance path 28 is provided on a lower part of the discharge unit 60. The discharge path 61 is a curved path extending from the sheet discharge port 22 to the reception port 25. The print sheet conveyed to the reception port 25 is guided to the sheet discharge port 22 by the discharge path 61. An external guide member 71 is disposed more in the rear side (external side) than the discharge path 61, and an internal guide member 72 is disposed more in the front side (internal side) than the discharge path 61. That is, a space is formed inside the discharge unit 60, the space being sandwiched by the external guide member 71 and the internal guide member 72 in the front-rear direction 7 and the up-down direction 6, and the space is the discharge path 61.

As shown in FIG. 5, the discharge path 61 is formed in a curved shape. Specifically, the discharge path 61 extends diagonally downward and rearward, then curves downward, and then extends almost along the vertical direction until it reaches the reception port 25. The external guide member 71 includes a plurality of curved guide ribs 71A that constitute an external guide surface of the discharge path 61. The guide ribs 71A stand along an inner surface of the external guide member 71. The internal guide member 72 is formed in the shape of extending in the up-down direction 6. The internal guide member 72 includes a plurality of guide ribs 72A that constitute an internal guide surface of the discharge path 61. The guide ribs 72A stand along an inner surface of the internal guide member 72.

The external guide member 71 and the internal guide member 72 are both insulators. Specifically, the external guide member 71 and the internal guide member 72 are resin molded products made of a synthetic resin having a low electric conductivity. The external guide member 71 and the internal guide member 72 constitute, together with the reinforcing frame 80, the housing of the discharge unit 60. An upper portion 71B of the external guide member 71 constitutes an upper part of the housing of the discharge unit 60, and a rear portion 71C of the external guide member 71 constitutes a rear side part of the housing of the discharge unit 60. In addition, the front surface of the internal guide member 72 constitutes a front side part of the housing of the discharge unit 60.

Figure 6:
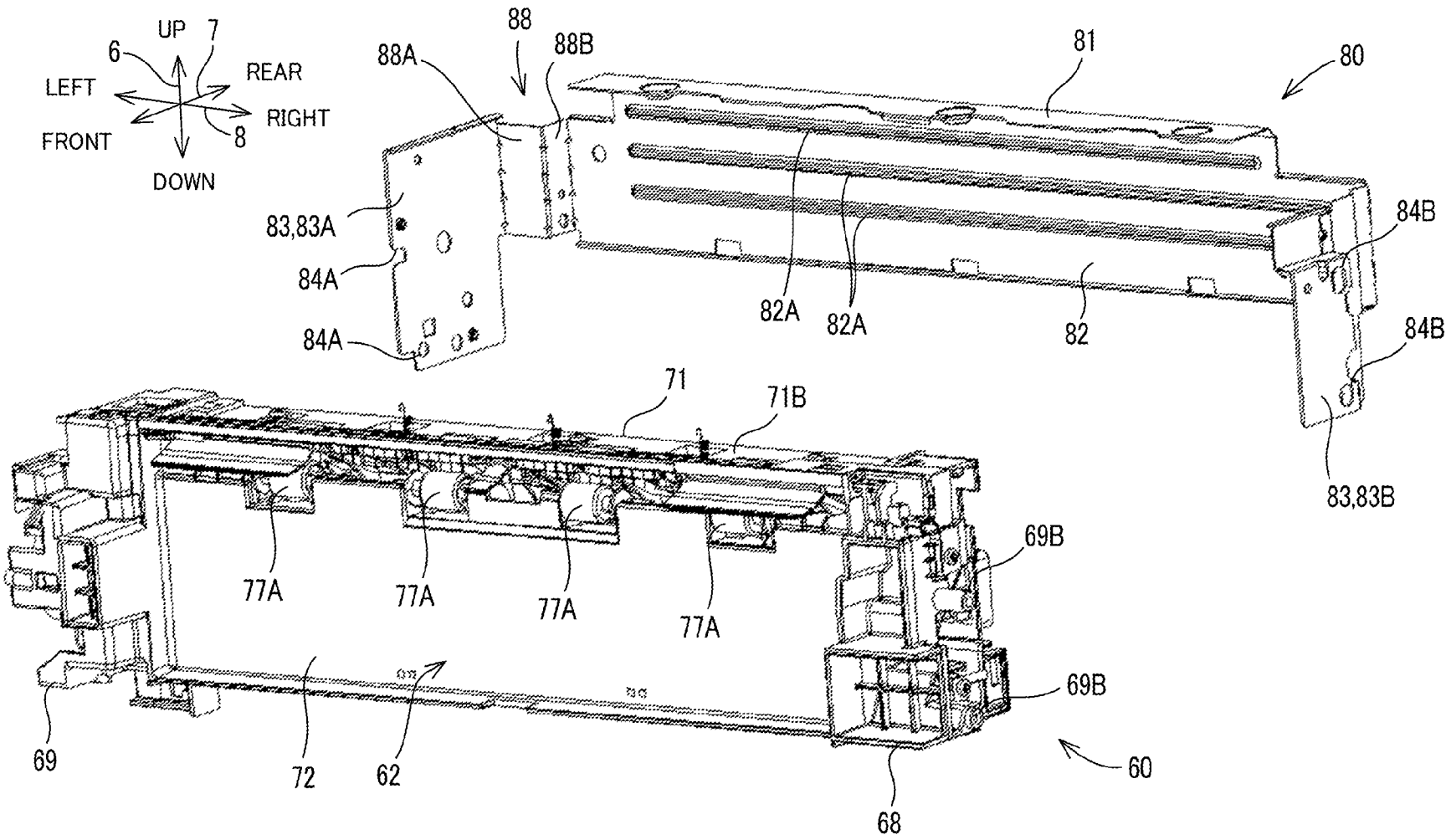
FIG. 6 is an exploded view of the discharge unit.

As shown in FIG. 4, supported portions 67 and 68 are formed at opposite ends of the internal guide member 72 in the left-right direction 8. The supported portion 67 is integrally formed with the left end portion of the internal guide member 72, and the supported portion 68 is integrally formed with the right end portion of the internal guide member 72. The external guide member 71 is fixed to the supported portions 67 and 68 by fixtures (not shown). In addition, the supported portions 67 and 68 play a role of the mounting seats to which various parts for use in the discharge unit 60 are attached, and play a role of the mounting seats by which the discharge unit 60 is attached and fixed to the housing 14. In the present embodiment, the discharge motor 64 is attached to the supported portion 67. As shown in FIG. 6 and FIG. 7, a plurality of cylindrical bosses 69 (69A, 69B) that are used for the attachment to the housing 14 are formed on the supported portions 67 and 68. The bosses 69A of the supported portion 67 project leftward from a side surface of the supported portion 67, and a screw hole is formed inside each of the bosses 69A. In addition, the bosses 69B of the supported portion 68 project rightward from a side surface of the supported portion 68, and a screw hole is formed inside each of the bosses 69B. The number of bosses 69 is determined based on, for example, the attachment strength to the housing 14. In the present embodiment, two bosses 69A are formed on the supported portion 67, and two bosses 69B are formed on the supported portion 68. It is noted that the attachment mechanism of the discharge motor 64 and the attachment mechanism of the discharge unit 60 to the housing 14 are described below.

The pair of discharge rollers 77 discharges a print sheet in the discharge path 61 to outside from the sheet discharge port 22. The pair of discharge rollers 77 is disposed near the sheet discharge port 22. Specifically, the pair of discharge rollers 77 is disposed more in the upstream side in the print sheet conveyance direction than the sheet discharge port 22. As shown in FIG. 4, in the present embodiment, a plurality of pairs of discharge rollers 77 are provided at predetermined intervals in the left-right direction 8. Specifically, four pairs of discharge rollers 77 are disposed in alignment in the left-right direction 8.

Each pair of discharge rollers 77 is composed of a driving roller 77A and a driven roller 77B that are pressed against each other. The driving roller 77A and the driven roller 77B are disposed to face each other across the discharge path 61. The driving roller 77A is rotatably supported by an upper end portion 72B of the internal guide member 72. A rotational driving force is transmitted to the driving roller 77A from the discharge motor 64 (see FIG. 7) via a transmission mechanism (not shown) such as a gear. Upon receiving the rotational driving force, the driving roller 77A rotates in a rotation direction corresponding to the input rotational driving force. The driven roller 77B is rotatably supported by an upper portion 71B of the external guide member 71. The driven roller 77B is biased toward the driving roller 77A by an elastic member (not shown) such as a coil spring. This enables the driven roller 77B to be always pressed against the surface of the driving roller 77A by an appropriate elastic biasing force. As a result, when the driving roller 77A is rotationally driven, the driven roller 77B rotates following the rotation of the driving roller 77A by the contact friction.

The conveyance roller 39 conveys a print sheet conveyed from the conveyance path 28 toward the discharge path 61. The conveyance roller 39 is rotatably supported by a lower end portion 72C of the internal guide member 72. A rotational driving force is transmitted to the conveyance roller 39 from the discharge motor 64 (see FIG. 7) via a transmission mechanism (not shown) such as a gear. The conveyance roller 39 and the driven roller 38 are pressed against each other in the state where the discharge unit 60 is attached to the housing 14. As a result, when the conveyance roller 39 is rotationally driven, the driven roller 38 rotates by the contact friction, following the rotation of the conveyance roller 39. When a print sheet reaches a nip portion formed between the conveyance roller 39 and the driven roller 38, the print sheet is conveyed while being nipped by the nip portion.

As shown in FIG. 5, the pressing member 74 is provided in the external guide member 71. The pressing member 74 is attached to an upper portion 71B of the external guide member 71. The pressing member 74 is attached to the upper portion 71B more in the upstream side than the sheet discharge port 22 in the print sheet discharge direction. The pressing member 74 projects from the upper portion 71B of the external guide member 71 toward the discharge path 61. In other words, the pressing member 74 projects from the upper portion 71B in a direction perpendicular to the discharge direction in which the print sheet is conveyed in the discharge path 61. As a result, the pressing member 74 can contact the print sheet that is being conveyed in the discharge path 61. A protruding portion 75 of the pressing member 74, protruding toward the discharge path 61, contacts and presses the upper surface of the print sheet that is passing through the discharge path 61. With this configuration, the pressing member 74 deforms the print sheet into a curved shape and stiffens the print sheet. In the present embodiment, three pressing members 74 are provided. In the image forming apparatus 10 viewed from the front, the three pressing members 74 are each disposed at a position corresponding to the center of each interval between the four driving rollers 77A. Pressed by the plurality of pressing members 74, the print sheet is deformed into a wave shape.

The pressing members 74 are supported by the upper portion 71B of the external guide member 71 so as to be displaced in a direction of separating from the upper portion 71B toward the discharge path 61 (separation direction). The separation direction is a downward direction in FIG. 5. An opening 65 is formed in the upper surface of the external guide member 71. The opening 65 passes through the upper portion 71B of the external guide member 71 in the up-down direction 6. The pressing members 74 are attached in the state where a part of them is embedded in the opening 65. Each of the pressing members 74 includes a projection portion 75 that passes through the opening 65 toward the discharge path 61. The projection portions 75 are inserted through the opening 65 and project toward the discharge path 61. The projection portions 75 are supported by the upper portion 71B of the external guide member 71 so as to be displaced in the up-down direction 6.

Each of the pressing members 74 includes two arms 76. The arms 76 are provided on each of the projection portions 75 that are to contact a print sheet. The two arms 76 extend upward from opposite ends of the projection portion 75 in the front-rear direction 7. A hook 76A that is oriented downward is formed on each of the arms 76. The arms 76 and the base portions of the arms 76 are embedded in the opening 65. The upper portion 71B of the external guide member 71 is provided with a pair of support plates 53 and 54 that are separated from each other in the front-rear direction 7. The support plate 53 extends upward from a rear-side edge of the opening 65, and the support plate 54 extends upward from a front-side edge of the opening 65. A through hole 55 is formed in each of the support plates 53 and 54, wherein the through holes 55 pass through the support plates 53 and 54 in the front-rear direction 7. The through holes 55 are long holes that are elongated in the up-down direction 6. The hooks 76A are inserted through the through holes 55, thereby the pressing members 74 are supported so as to be displaced from the opening 65 in the up-down direction 6. It is noted that the length by which the pressing members 74 can be displaced in the up-down direction 6 is limited to the length of the through holes 55 in the up-down direction 6. That is, the amount of displacement of the pressing members 74 is determined by the length of the through holes 55 in the up-down direction 6. In addition, the amount of projection of the projection portions 75 toward the discharge path 61 is determined based on the extent to which a print sheet is curved.

Each of the pressing members 74 is elastically biased downward by an elastic member 56 such as a spring. By being elastically biased by the elastic member 56, a force that presses the conveyed print sheet is generated in each of the pressing members 74. Specifically, each of the plurality of pressing members 74 is biased by the elastic member 56 in a direction of separating from the upper portion 71B of the external guide member 71 downward. As shown in FIG. 5, a lower end of the elastic member 56 is supported by the upper surface (a surface facing in a direction opposite to the separation direction) of the projection portion 75 of the pressing member 74. A cylindrical support portion 75A is provided on the upper surface of the projection portion 75 such that the support portion 75A is fitted on and holds the lower end of the elastic member 56. With the lower end of the elastic member 56 being inserted into the support portion 75A, the lower end portion of the elastic member 56 is supported.

In the present embodiment, a coil spring formed from a metal wire having conductivity, or a plate spring formed from a metal plate having conductivity, is used as the elastic member 56. It is noted that the elastic member 56 is not limited to a spring as far as it can elastically biases the pressing member 74 downward. In addition, the elastic member 56 is not limited to a metal material as far as it has conductivity.

[Reinforcing Frame 80]

The reinforcing frame 80 is provided for the purpose of increasing the rigidity of the discharge unit 60 to increase the strength. The reinforcing frame 80 is formed from a metal plate material. As shown in FIG. 3 and FIG. 4, the reinforcing frame 80 is disposed to cover the external guide member 71 from the rear side of the discharge unit 60. In the present embodiment, as shown in FIG. 5, the reinforcing frame 80 covers the part of the external guide member 71 to which the pressing members 74 are attached, namely, covers the upper surface of the upper portion 71B of the external guide member 71 corresponding to the attachment position of the pressing members 74. As described above, the pressing members 74 are biased by the elastic members 56. As a result, the upper end portions of the elastic members 56 abut on and are supported by the inner surface of the reinforcing frame 80 in the state where the upper portion 71B is covered with the reinforcing frame 80. In this state, the pressing members 74 indirectly contact the reinforcing frame 80 via the elastic members 56. In addition, the elastic members 56 have conductivity, and the pressing members 74 and the reinforcing frame 80 have conductivity, too. As a result, when the elastic members 56 contact the pressing members 74 and the reinforcing frame 80, the pressing members 74 go into the state where electric charges can move to and from the reinforcing frame 80. As a result, the electric charges charged to the pressing members 74 can move to the reinforcing frame 80 through the elastic members 56.

The reinforcing frame 80 and the internal guide member 72 are fixed to the side frames 14A and 14B of the housing 14, wherein the reinforcing frame 80 is fixed in the state of covering the external guide member 71 from outside (from the rear side in FIG. 5). With this configuration, the reinforcing frame 80 reinforces the discharge unit 60. As described above, the side frame 14A has conductivity and is grounded by a ground line. As a result, when the reinforcing frame 80 is fixed to the side frames 14A and 14B, they electrically contact with each other, and thus the electric charges that have moved from the pressing members 74 to the reinforcing frame 80, move from the side frame 14A to the ground. This prevents charging of the pressing members 74.

Figure 8:
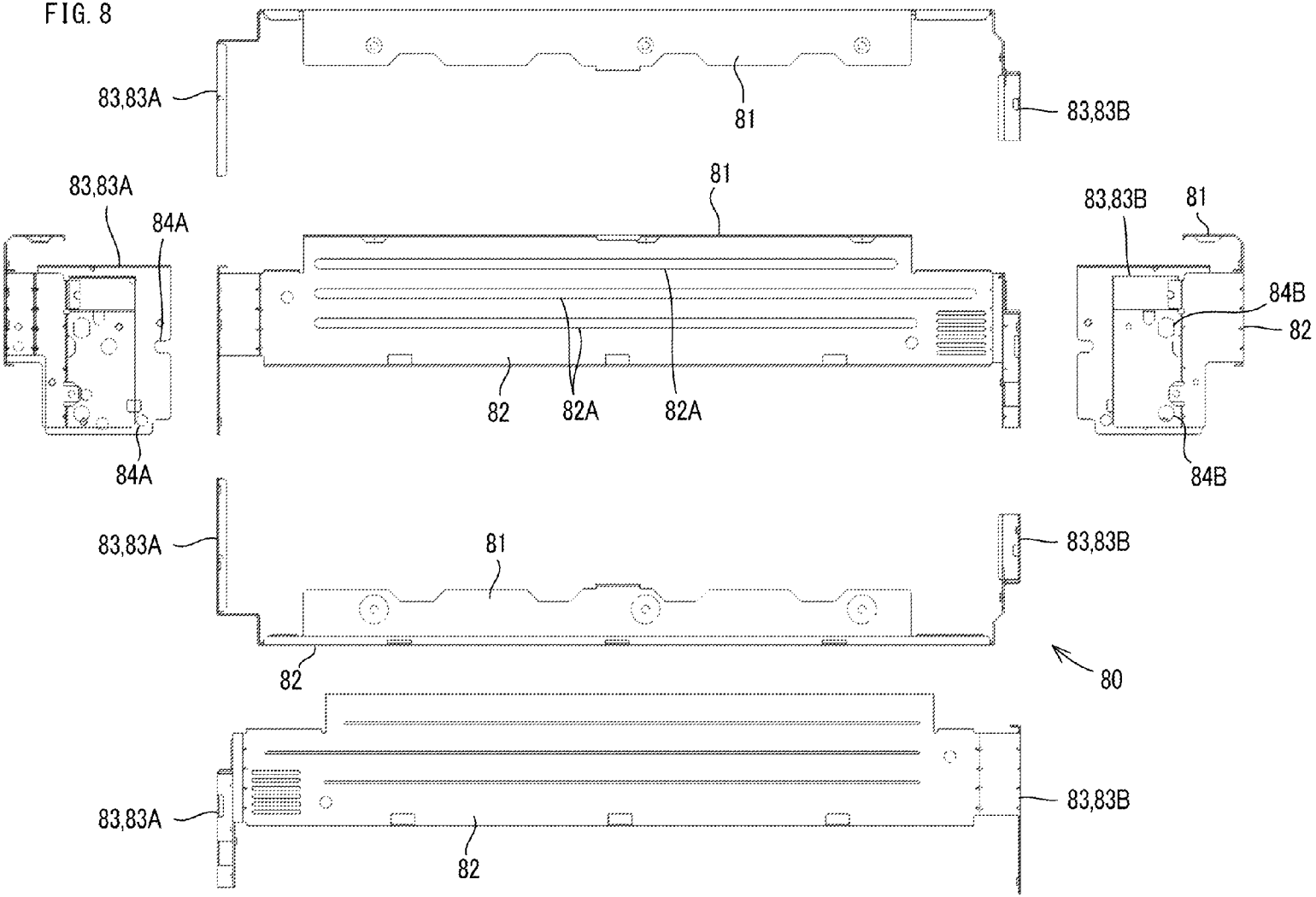
FIG. 8 is a six-surface view showing a reinforcing frame of the discharge unit.

The following describes the reinforcing frame 80. As shown in FIG. 6 to FIG. 8, the reinforcing frame 80, as is the case with the discharge unit 60, is formed in the shape of being elongated in the left-right direction 8. The reinforcing frame 80 is formed by cutting and bending a sheet of metal plate material. The reinforcing frame 80 of the present embodiment is composed of a base plate 82 (an example of the second plate), an upper plate 81 (an example of the first plate), and a side plate 83 (an example of the third plate). The plates 81-83 are integrally formed into the reinforcing frame 80.

The upper plate 81 is a thin and long plate member that extends in the left-right direction 8 in the state where the discharge unit 60 is attached to the housing 14. As shown in FIG. 4 and FIG. 5, the upper plate 81 covers the upper surface of the upper portion 71B of the external guide member 71. In addition, as shown in FIG. 5, the upper plate 81 covers the upper surface of the upper portion 71B corresponding to the attachment position of the pressing members 74. The upper end portions of the elastic members 56 are supported by the upper plate 81.

The base plate 82 is connected to the rear end portion of the upper plate 81, and is a plate member that extends downward in the vertical direction from the rear end portion of the upper plate 81. As shown in FIG. 6 and FIG. 7, the base plate 82 is formed in a size having approximately the same area as the rear surface (a side surface of the rear side) of the external guide member 71 such that it can cover the rear surface of the external guide member 71. The base plate 82 includes three reinforcing ribs 82A that extend in the left-right direction 8, so as to reinforce the rigidity of the base plate 82 itself.

The side plate 83 is formed at each of opposite ends of the reinforcing frame 80 in the left-right direction 8. A side plate 83A is formed at the left end of the reinforcing frame 80, and a side plate 83B is formed at the right end of the reinforcing frame 80. The side plates 83A and 83B are each connected to the upper plate 81 and the base plate 82. The side plate 83A is formed to be larger in size than the side plate 83B. The side plate 83A covers the discharge motor 64 in the state where the discharge motor 64 is attached to the supported portion 67. In the present embodiment, the side plate 83A is, together with the supported portion 67 of the discharge unit 60, fixed to the side frame 14A of the housing 14 in the state where it covers the discharge motor 64. In addition, the side plate 83B is, together with the supported portion 68, fixed to the side frame 14B of the housing 14 in the state where it covers the supported portion 68.

Two through holds 84A are formed in the side plate 83A at positions that correspond to the two bosses 69A of the supported portion 67. In addition, two through holds 84B are formed in the side plate 83B at positions that correspond to the two bosses 69B of the supported portion 68.

Figure 9:
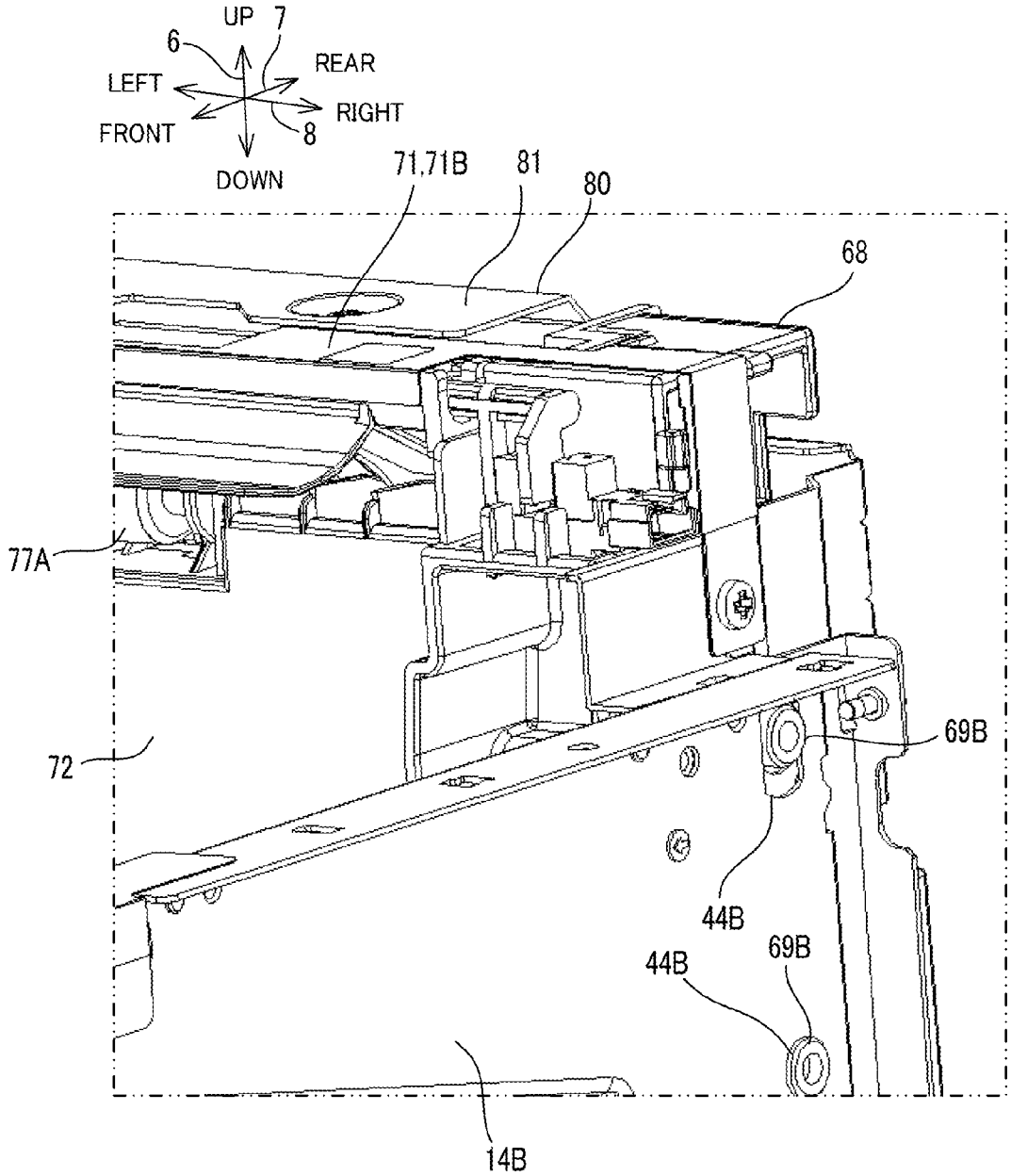
FIG. 9 is an enlarged view of a main part IX in FIG. 3.

As shown in FIG. 9, the side plate 83B is, together with the supported portion 68, attached to the side frame 14B. Here, FIG. 9 shows a state where the reinforcing frame 80 and the discharge unit 60 are attached to the housing 14. Attachment holes 44B are formed in the side frame 14B for the attachment of the supported portion 68 and the side plate 83B. Two attachment holes 44B are formed in the side frame 14B. The bosses 69B are inserted through the attachment holes 44B, respectively. It is noted that the supported portion 67 is, together with the side plate 83A, attached to the side frame 14A. As a result, like the attachment holes 44B, attachment holes (not shown) are formed in the side frame 14A for the attachment of the supported portion 67 and the side plate 83A.

Figure 10:
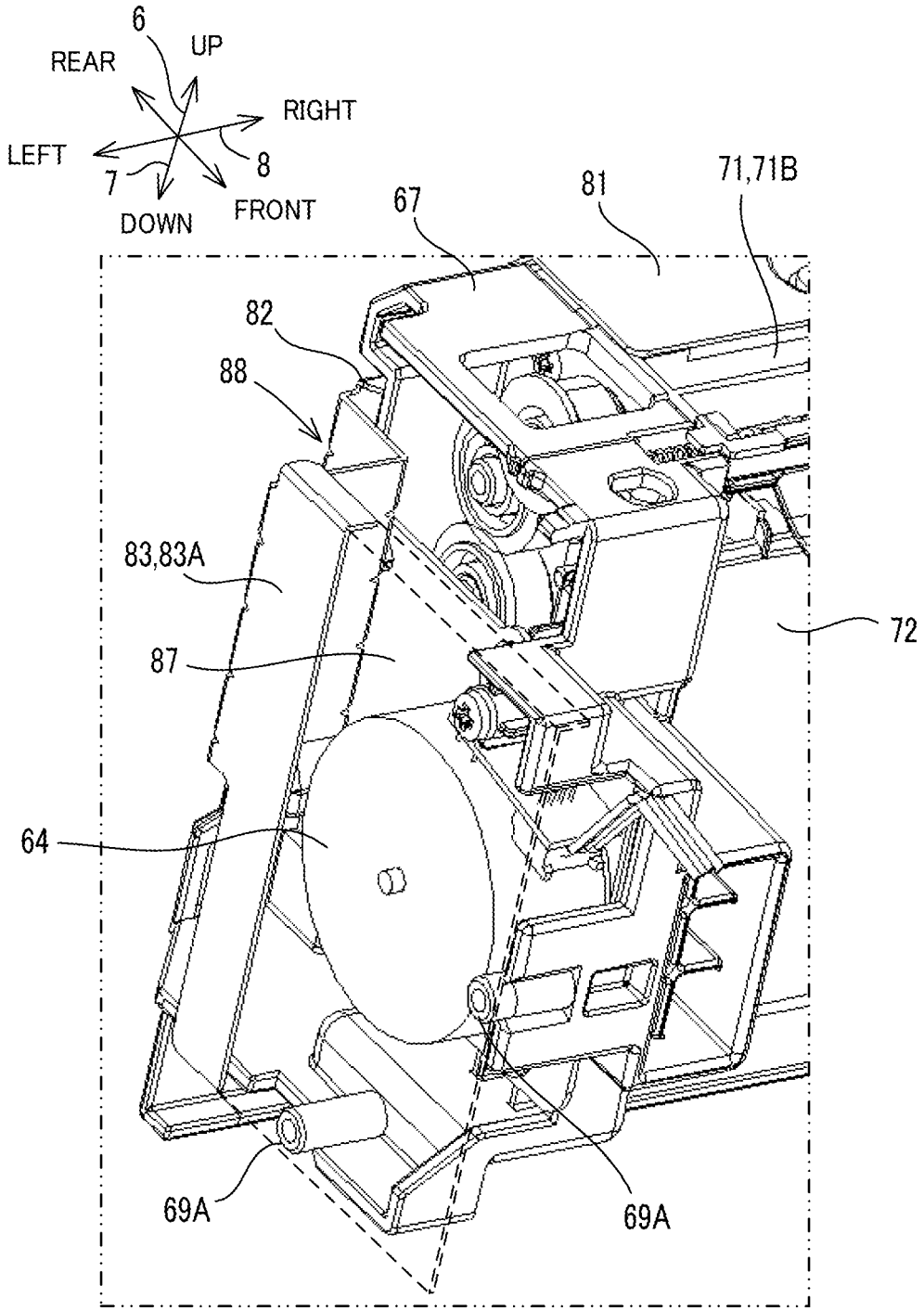
FIG. 10 is an enlarged view of an end portion of the discharge unit in the longitudinal direction.

As shown in FIG. 10, the discharge motor 64 is attached to a side surface of the discharge unit 60 in the longitudinal direction. Here, FIG. 10 shows a positional relationship between the reinforcing frame 80 and the discharge unit 60 in the state where the reinforcing frame 80 and the discharge unit 60 are attached to the housing 14. In addition, FIG. 10 partially shows the left end portion of the discharge unit 60. In FIG. 10, for the sake of explanation, the side plate 83A is omitted to be shown, and the omitted part is indicated by a broken line. As shown in FIG. 10, the discharge motor 64 is attached to a side surface of the supported portion 67. The discharge motor 64 is attached to the side surface of the supported portion 67 via a bracket 87. The bracket 87 is formed from a metal plate material. Screw holes for fixing the discharge motor 64, attachment holes for fixing the bracket 87 to the supported portion 67, and the like are formed on the bracket 87. The bracket 87 is fixed to the supported portion 67 by fixtures such as screws. Furthermore, the discharge motor 64 is fixed to the bracket 87 by fixtures such as screws. With this configuration, the discharge motor 64 is fixed to the supported portion 67 via the bracket 87. In the present embodiment, the side plate 83A covers a side surface of the supported portion 67 from outside of the discharge motor 64 in the state where the reinforcing frame 80 and the discharge unit 60 are attached to the housing 14.

It is noted that, as shown in FIG. 10, the bracket 87 is formed to be larger in size than the discharge motor 64, and the discharge motor 64 is attached so that it can contact the surface of the bracket 87 by the surface contact. As a result, the heat that is generated by the rotation of the discharge motor 64 is transmitted to the bracket 87. In addition, since, as described below, the bracket 87 and the side plate 83A are connected to each other, the heat transmitted to the bracket 87 is transmitted to the side plate 83A. With this configuration, since the heat of the discharge motor 64 is dissipated, efficient heat dissipation is realized.

As shown in FIG. 7, the side plate 83A includes a step portion 88. The step portion 88 includes a first step surface 88A and a second step surface 88B, wherein the first step surface 88A extends rightward from a rear end portion of the side plate 83A at right angle thereto, and the second step surface 88B extends rearward from the first step surface 88A at right angle thereto and connects to a left end portion of the base plate 82. The interval between the second step surface 88B and the side plate 83A is approximately the same as the interval between the bracket 87 and the external surface of the discharge motor 64. In the present embodiment, as shown in FIG. 10, the bracket 87 is connected to the side plate 83A in the state where the reinforcing frame 80 and the discharge unit 60 are attached to the housing 14. Specifically, the bracket 87 is connected to the second step surface 88B of the side plate 83A. A screw hole 87A is formed in the bracket 87, and a through hole 89 is formed in the second step surface 88B. When the reinforcing frame 80 and the discharge unit 60 are attached to the housing 14, the side plate 83A is positioned at the bracket 87, and at this time, the second step surface 88B contacts the surface of the bracket 87 by the surface contact. In this state, a fixture such as a screw is inserted through the through hole 89 and the screw hole 87A. This allows the bracket 87 and the side plate 83A to be connected to each other in the state where they contact each other by the surface contact. As a result, heat transmission from the bracket 87 to the side plate 83A becomes possible, and movement of electric charges therebetween becomes possible.

The reinforcing frame 80 and the discharge unit 60 configured as described above are attached to the side frames 14A and 14B of the housing 14, as follows. First, the reinforcing frame 80 is temporarily fixed to the discharge unit 60. Specifically, the reinforcing frame 80 is attached to the rear surface of the discharge unit 60 in the state where the side plates 83A and 83B of the reinforcing frame 80 are spread. At this time, the bosses 69A of the supported portion 67 are inserted through the through holes 84A of the side plate 83A, and the bosses 69B of the supported portion 68 are inserted through the through holes 84B of the side plate 83B. Next, opposite end portions of the discharge unit 60 are fixed to the side frames 14A and 14B in the state where the reinforcing frame 80 is temporarily fixed. Specifically, the bosses 69A and 69B of the supported portions 67 and 68 are inserted through the attachment holes of the side frames 14A and 14B, respectively. Subsequently, fixtures such as screws are inserted through the bosses 69A and 69B from outside the side frames 14A and 14B. In this way, the reinforcing frame 80 and the discharge unit 60 are fixed to the side frames 14A and 14B.

Meanwhile, a conventional discharge unit includes an electricity removing brush (electricity removing member) for removing static electricity from print sheets. In such a conventional discharge unit, when the pair of discharge rollers 77 are supported by metal shafts, a discharge of static electricity may be generated between the metal shafts and a print sheet before the print sheet reaches the electricity removing brush. In addition, not limited to the metal shafts, when conductive members such as metal frames and screws are disposed in such a way as to be exposed to the discharge path 61, static electricity of a print sheet may be discharged to the conductive members. In particular, in a configuration where the pressing members 74 are provided, the pressing members 74 are positively contacted with the print sheet, and due to the charging generated by the contact friction, the amount of charges of static electricity increases prominently on both the print sheet and the pressing members 74. As a result, the print sheet immediately after passing through the pressing members 74 has the largest amount of charges of static electricity and is in the state where a discharge is likely to occur. In addition, since static electricity is also charged on the pressing members 74, when the next print sheet approaches the pressing members 74, a discharge may be generated between the pressing members 74 and the print sheet. The static electricity discharged near the sheet discharge port may generate a noise that may cause the peripheral equipment to malfunction, as well as electronic devices mounted in the image forming apparatus 10. In addition, when the print sheet on which an image can be formed is upsized while the discharge unit is being downsized, the discharge unit becomes thinner and longer in the width direction. This decreases the rigidity of the discharge unit. In these circumstances, realizing both the downsizing and improvement of the rigidity of the discharge unit is desired.

With the above-described configuration of the reinforcing frame 80 and the discharge unit 60, it is possible to reduce the amount of charges on the pressing members 74 by causing the charges to move from the pressing members 74 in the state where the reinforcing frame 80 and the discharge unit 60 are attached to the housing 14. This prevents a discharge from occurring to the pressing members 74. In addition, in a case where a print sheet being conveyed in the discharge path 61 has been charged with static electricity, the print sheet reaches and contacts the pressing members 74, which allows electric charges that have been charged on the contact part of the pressing members 74, to move to the ground from the pressing members 74 via the elastic members 56, reinforcing frame 80, and side frame 14A. This allows the amount of charges on the print sheet to be reduced. In addition, with the configuration where the reinforcing frame 80 covers the discharge unit 60 in such a manner that the upper plate 81, base plate 82, and side plate 83 surround the discharge unit 60, the rigidity and strength of the discharge unit 60 are increased. In addition, if a discharge of static electricity occurs near the sheet discharge port 22, the reinforcing frame 80 formed from a metal plate plays a role of an electromagnetic shield, thereby it is possible to prevent an irradiation of electric wave noise from occurring due to a discharge of static electricity to outside of the reinforcing frame 80. That is, according to the image forming apparatus 10 of the present embodiment, it is possible to improve the rigidity of the discharge unit 60, reduce the amount of charges of static electricity near the sheet discharge port 22, and prevent troubles from occurring due to a noise that would be generated by a discharge of static electricity.

Furthermore, the discharge motor 64 is attached to the supported portion 67 of the internal guide member 72 via the bracket 87, and the side plate 83A of the reinforcing frame 80 is further provided outside thereof. As a result, it is possible to effectively dissipate the heat that has been generated in the discharge motor 64, through the side plate 83A. In addition, since the bracket 87 and the side plate 83A are connected to each other, static electricity accumulated in the discharge motor 64 can be moved to the ground.

In the above-described embodiment, a print sheet passes through the fixing portion 19, the conveyance path 28, and the discharge path 61, and is discharged from the sheet discharge port 22. As a result, the heat that is generated in the heating roller 41 of the fixing portion 19 rises together with the surrounding air and passes through the conveyance path 28 and the discharge path 61. At this time, the heat is transmitted to the reinforcing frame 80 directly or indirectly via the external guide members 71 and 72. This allows a high dissipation effect to be gained, and makes it possible to prevent the peripheral of the discharge path 61 from having high temperature.

In the above-described embodiment, the pressing members 74 indirectly contact the reinforcing frame 80 via the elastic member 56. However, not limited to this, the pressing members 74 may directly contact the reinforcing frame 80.

In the above-described embodiment, the pressing members 74 have conductivity. However, the present disclosure is not limited to the configuration. The pressing members 74 may not have conductivity. In this case, movement of electric charges charged on the pressing members 74 cannot be expected, but when a discharge of static electricity occurs in the peripheral of the pressing members 74, the electric wave noise generated by the discharge can be blocked by the reinforcing frame 80.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a discharge unit including a guide member that forms a discharge path that guides a sheet member after image formation to a sheet discharge port, the discharge unit being attached to an apparatus main body;

a discharge roller disposed in a vicinity of the sheet discharge port of the discharge unit, and configured to discharge the sheet member in the discharge path to outside from the sheet discharge port;

a pressing member attached to the guide member more in an upstream side than the sheet discharge port in a sheet member discharge direction, the pressing member projecting from the guide member toward the discharge path and configured to contact and press the sheet member that is passing through the discharge path; and a reinforcing frame formed from a metal plate material, made conductive with a reference potential portion of the apparatus main body, and configured to reinforce the discharge unit by being, together with the discharge unit, fixed to the apparatus main body in a state of covering a part of the guide member to which the pressing member is attached, wherein the pressing member is made of a material that has conductivity, and the reinforcing frame is in contact with the pressing member.

2. The image forming apparatus according to claim 1, wherein the reference potential portion is made of a conductive material and is a housing of the apparatus main body.

3. An image forming apparatus comprising:

a discharge unit including a guide member that forms a discharge path that guides a sheet member after image formation to a sheet discharge port, the discharge unit being attached to an apparatus main body;

a discharge roller disposed in a vicinity of the sheet discharge port of the discharge unit, and configured to discharge the sheet member in the discharge path to outside from the sheet discharge port;

a pressing member attached to the guide member more in an upstream side than the sheet discharge port in a sheet member discharge direction, the pressing member projecting from the guide member toward the discharge path and configured to contact and press the sheet member that is passing through the discharge path; and a reinforcing frame formed from a metal plate material, made conductive with a reference potential portion of the apparatus main body, and configured to reinforce the discharge unit by being, together with the discharge unit, fixed to the apparatus main body in a state of covering a part of the guide member to which the pressing member is attached, wherein the pressing member is supported by the guide member so as to be displaced in a separation direction of separating from the guide member toward the discharge path, the image forming apparatus further comprising an elastic member whose one end is supported by a surface of the pressing member, the surface facing in a direction opposite to the separation direction, and whose another end is supported by an inner surface of the reinforcing frame, the elastic member being made of a conductive material.

4. The image forming apparatus according to claim 3, wherein the sheet discharge port is formed on a side surface of the discharge unit, the discharge path is formed in a curved shape so as to extend from the sheet discharge port diagonally downward, then be curved, and then extend downward, the guide member includes an external guide member and an internal guide member, the external guide member being disposed outside the discharge path, the internal guide member being disposed inside the discharge path, the reinforcing frame includes a first plate and a second plate, the first plate covering an upper surface of the external guide member, the second plate being connected to the first plate and covering a side surface of the external guide member, the pressing member includes a projection portion that is attached to the external guide member and passes through an opening toward the discharge path and projects to the discharge path, the opening being formed in the upper surface of the external guide member, and the one end of the elastic member is supported by the projection portion, and the other end of the elastic member is supported by an inner surface of the first plate.

5. The image forming apparatus according to claim 4, wherein the discharge unit is formed in a shape of being elongated in a width direction perpendicular to a discharge direction in the discharge path, and a motor for driving the discharge roller is attached to a side surface of the discharge unit via a bracket that is formed from a metal plate material, the reinforcing frame includes a third plate that is connected to the second plate, and is, together with the discharge unit, fixed to the apparatus main body in a state of covering the motor, and the bracket is connected to the third plate.

6. The image forming apparatus according to claim 3, wherein the reference potential portion is made of a conductive material and is a housing of the apparatus main body.

* * * * *